US005647435A

United States Patent [19]

Owens et al.

[11] Patent Number: 5,647,435

[45] Date of Patent: Jul. 15, 1997

[54] CONTAINMENT OF DOWNHOLE ELECTRONIC SYSTEMS

[75] Inventors: Steve Owens, The Woodlands; Brett Bouldin, Pearland; Gary Elliott, Magnolia, all of Tex.

[73] Assignee: PES, Inc., The Woodlands, Tex.

[21] Appl. No.: 533,282

[22] Filed: Sep. 25, 1995

[51] Int. Cl.[6] ..... E21B 47/00

[52] U.S. Cl. ..... 166/250.01; 250/256

[58] Field of Search ..... 166/250.01, 254.2, 166/65.1, 66, 86.1, 163, 165; 165/104.33; 250/254, 256

[56] References Cited

U.S. PATENT DOCUMENTS

| | | | |
|---|---|---|---|
| 4,093,854 | 6/1978 | Turcotte et al. | 250/269 |
| 4,629,888 | 12/1986 | Wolk | 250/256 |
| 4,671,349 | 6/1987 | Wolk | 165/47 |
| 4,673,652 | 6/1987 | McStravick et al. | 436/2 |
| 5,061,849 | 10/1991 | Meisner et al. | 250/254 |
| 5,530,358 | 6/1996 | Wisler et al. | 324/338 |

*Primary Examiner*—Frank Tsay

[57] ABSTRACT

An apparatus and method for protecting downhole electronic components and for monitoring the deterioration of such components. The electronic components are positioned within a tool recess, and a vacuum is drawn on the recess to remove oxygen, water vapor, and other contaminants from contact with the electronic components. In one embodiment of the invention, insulating fluid or an inert gas can be placed in the recess to isolate the electronic components. The seal integrity of the recess can be tested before the tool is run into the well or before the tool is set in the well. A pressure sensor monitors the deterioration of the vacuum, or fluctuations in the pressure of the insulating fluid or inert gas, to detect leakage of well fluids into the recess, leakage of gas away from the recess, or to detect gases formed from corrosion of the electronic components.

12 Claims, 2 Drawing Sheets

CONTAINMENT OF DOWNHOLE ELECTRONIC SYSTEMS

BACKGROUND OF THE INVENTION

The present invention relates to the use of electronic systems in a well. More particularly, the present invention relates to a system for extending the life span and reliability of downhole electronic systems in a well, and for monitoring the operation of such electronic systems.

The development of hydrocarbon producing wells requires the installation of well completion equipment to monitor and control fluid flow. The characteristics of the well are monitored by the completion equipment and are transmitted to the surface. The transmitted data is analyzed by a reservoir management system, and completion equipment such as valves, sliding sleeves, packers and other completion tools are operated to control the well.

Electronic systems have been incorporated into well completion equipment. However, electronic systems downhole in a well may not adequately perform over the producing life of a well. If an electronic system should fail, reservoir management data and completion control operations would be interrupted until the equipment is repaired. This failure would interrupt well operations and would increase production costs.

High downhole temperatures in wells substantially reduce the life span of electronics in downhole equipment. Downhole well temperatures can exceed 150 degrees Centigrade, and such temperatures accelerate the corrosion mechanisms affecting electronic systems. Such corrosion mechanisms are accelerated by the presence of oxygen and water vapor in contact with metal components within the electronic systems.

Efforts have been made to mitigate the limitations presented by electronic systems downhole in wells. For example, one system uses fiber optics to operate a downhole pressure gauge system. The gauge senses downhole pressure changes through a response created by changes in the refractive index of a material caused by pressure fluctuations. The change in response is measured at the surface by monitoring changes in the optical signal transmitted from the surface to the downhole gauge and returned to the surface through a fiber optic cable.

Although optical systems may be useful with certain gauges, optical systems are limited because many well conditions and characteristics do not provide a direct optical response. Optical systems are also limited by the amount of power that can be transmitted by an fiber optic cable. Consequently, optical systems cannot perform the same functions provided by electronic systems for the processing of information or regulation of power.

Modern electronic systems are manufactured from a variety of metal alloys and other materials. Such alloys furnish key components for the functionality of the electronic systems, and include solders, metalized portions of the integrated circuits, etched copper alloys of printed circuit boards, and other metalizations used in the construction of printed circuit boards. These materials and compositions deteriorate with time and elevated temperatures.

Insulating flasks have been used in well logging tools to shield electronic components from high well temperatures. Dewar flasks have been used to insulate electronic logging components as the well logging tool is run in a well. While Dewar flasks successfully insulate downhole components for a limited time, the interior flask temperature eventually equalizes with the ambient well temperature and the thermal protection is lost.

Improvements to Dewar flask technology have been proposed to protect downhole electronic. U.S. Pat. No. 3,265,893 to Rabson et al. (1966) described a well logging tool having a thermally conductive heat sink for stabilizing the temperature in the logging tool for up to twenty hours. U.S. Pat. No. 4,671,349 to Wolk (1987) described a heat transfer wick for cooling the components of a well logging instrument for up to six hours during the interval of greatest heat exposure, and U.S. Pat. No. 3,488,970 to Hallenburg (1970) disclosed a module for cooling a water reservoir so that the cooled water could be pumped to transfer heat from the logging tool housing.

None of these techniques propose a system for protecting downhole electronic components over long time periods. Moreover, none of these systems propose a solution for monitoring the deterioration of electronic components within a downhole well tool. Accordingly, there is a need for a system that can perform these functions over the life of the well.

SUMMARY OF THE INVENTION

The present invention provides a system and method for containing electronic components in a downhole well tool. The system comprises a cavity within the tool for containing the electronic components. A wire is attached to the electronic components and extends outside of the cavity. A seal between the wire and the tool isolates the cavity from the well, and a vacuum pump engaged with the cavity creates a vacuum within the cavity to remove oxygen and water vapor from contact with the electronic components.

In another embodiment of the invention, a pressure sensor detects the pressure within the cavity, or a gas detector detects the presence of gas, and a signal is generated. A controller positioned at the well surface receives the signal and displays information indicating the cavity pressure or gas information.

The method of the invention comprises the steps of positioning the electronic components in a cavity within the tool and closing the cavity to isolate the cavity from the well. A vacuum is created within the cavity, and the well tool is positioned downhole in the well. The deterioration of the electronic components or leakage within the cavity can be detected by a pressure sensor, and the signals generated by the pressure sensor can be transmitted to a controller at the well surface. In other embodiments, inert gas or insulating fluid can be positioned within the cavity after the vacuum has been created.

DESCRIPTION OF THE PREFERRED EMBODIMENTS

The present invention provides a novel apparatus and method for extending the life span and reliability of an electronic system within a well tool. The invention is particularly useful in well control and monitoring devices that remain downhole for extended time periods.

Figure 1:
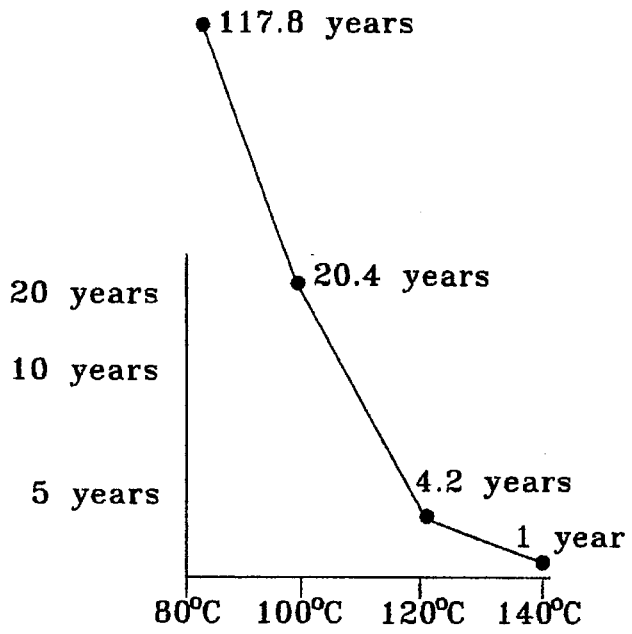
FIG. 1 illustrates the decay of electronic components over time when plotted against temperature increases.

FIG. 1 illustrates the decay of an electronic system as a function of time and temperature. As shown, the "life span" decreases exponentially as temperature increases. This principle is mathematically stated by the Arrhenius equation, and broadly defines the performance of semiconductor devices over time. Because of this relationship, the life span of an electronic component is approximately halved for every ten degrees increase in temperature. As shown in FIG. 1, the life span of the integrated circuit population sample is 117.8 years at 80 degrees Centigrade and was reduced to one year at 140 degrees Centigrade.

Figure 2:
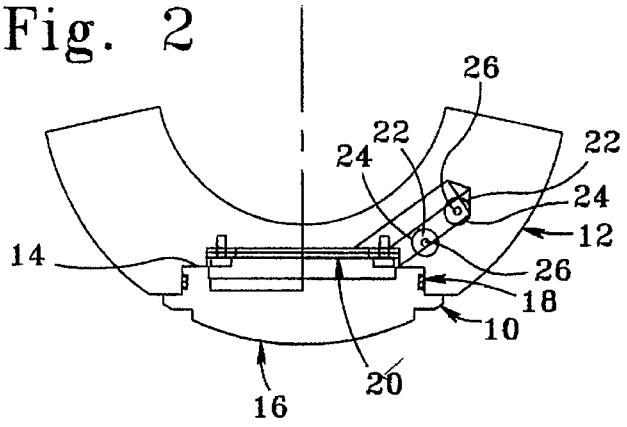
FIG. 2 illustrates a plan view of an electronic system within a production string.

FIG. 2 shows well completion tool 10 positioned with completion tubing 12. Cavity or recess 14 is milled or otherwise formed in the side of tool 10 and provides a space for other components as described below. Cover 16 is positioned over recess 14, and seal 18 isolates recess 14 from the pressurized well environment. Cover 16 can be attached to tool 10 with conventional techniques such as bolts, clips, or by welding procedures. Cover 16 preferably has a profile that does not provide protrusions or obstructions extending beyond the exterior surface of tool 10 or tubing 12.

Printed circuit board ("PCBA") 20 is positioned within recess 14 and can be connected to sensors, control switches, or other equipment useful in well operations. Electrical feed through connector 22 is engaged with bulkhead 24 and permits wire 26 to transmit signals and power between PCBA 20 and equipment outside of recess 14. Wire 26 can extend to the well surface to permit operations to be monitored and controlled from the well surface. Bulkhead 24 permits electrical islolation of PCBA from the ambient well conditions and prevents the movement of fluids therebetween.

Figure 4:
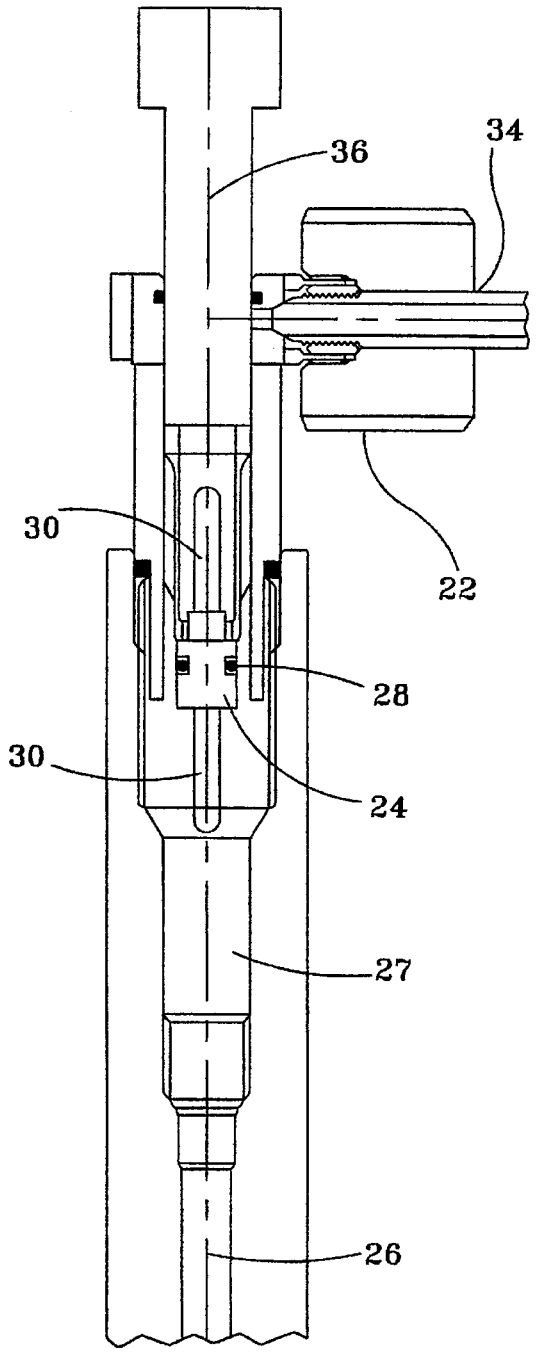
FIG. 4 illustrates an apparatus for creating a vacuum around electronic components in a well tool.
Figure 3:
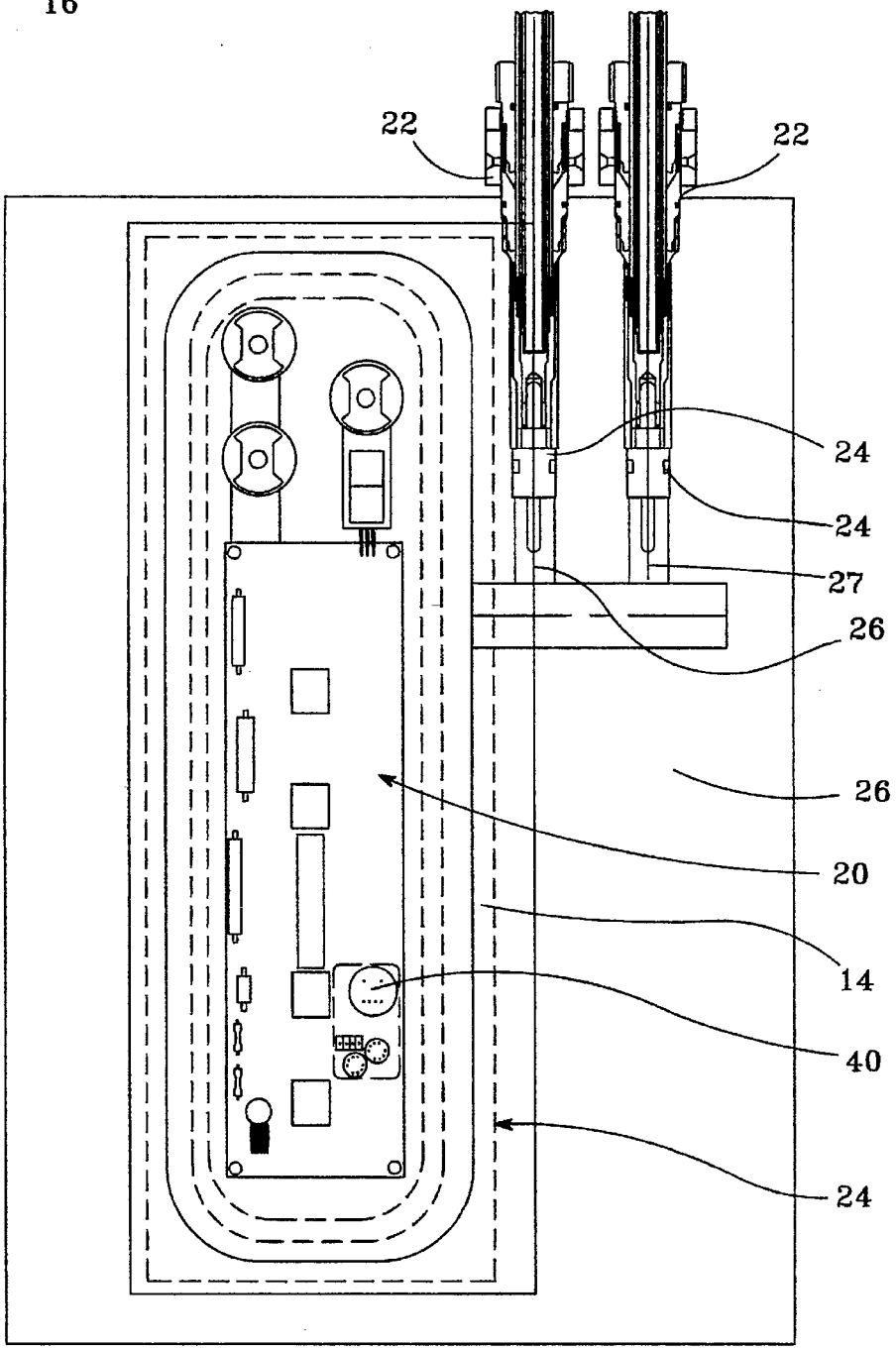
FIG. 3 illustrates an elevation view of an electronic system within a production string.

FIG. 3 shows an elevation view of tool 10 wherein cover 16 has been removed to show the interior components. PCBA 20 is connected to wire 26 for the transmission of signals and power. Electrical feed through connectors 22 provide the bridge between recess 14 and the ambient well environment. FIG. 4 shows detail of electrical feed through connectors 22 as such components are engaged with tool housing 27. Bulkhead 24 includes seal 28 for sealing the annulus between bulkhead 24 and tool housing 27, and further includes electrical pin contacts 30 which provide an electrical link between different sections of wire 26. Seal 32 provides a seal between electrical feed through connector 22 and tool housing 27.

In operation, electrical feed through connector 22 includes vacuum nipple 34 which permits a vacuum pump (not shown) to create a vacuum within recess 14. In the embodiment shown in FIG. 4, such vacuum can be drawn before bulkhead 24 is sealed with tool housing 27, or can be provided through an independent access port. After the vacuum has been created within recess 14, bulkhead 24 can be positioned with rod 36 to provide the permanent seal for recess 14 before the vacuum pump is disconnected, and vacuum nipple 34 can be disconnected from contact with tool housing 27 and electrical feed through connector 22. Consequently, a vacuum can be created within recess 14 to remove oxygen, water vapor, and other contaminants from recess 14 which would corrode PCBA 22 and other components within the elctronic system.

Pressure sensor 40 is engaged with PCBA and monitors the pressure within recess 14. If desired, temperature sensors can be attached with PCBA to monitor pressure fluctuations as a function of temperature. The signals provided by pressure sensor 40 are communicated to PCBA 20 and can be communicated with wire 26 to the well surface. If pressure sensor 40 detects that the vacuum within recess 14 becomes less, then such information might indicate the presence of a leak in the integrity of the seal between cover 16 and tool housing 27, or in the integrity of seal 28 between bulkhead 24 and tool housing 27. Consequently, pressure sensor 40 provides a novel technique of monitoring the potential failure of PCBA 20 due to contamination from fluids within the well.

Pressure sensor 40 also provides a mechanism for monitoring the degradation of metallic components in PCBA 20 and in other components within recess 14. As such metallic components deteriorate, gases are released which would reduce the vacuum within recess 14 and would be detected with pressure sensor 40. Over time, such deterioration of the vacuum would permit the long term degration of the PCBA to be evaluated from the well surface without pulling tool 10 from the well. This unique feature of the invention increases the efficiency of well operations by providing measurable data for predicting failure before the well must be shut down for unscheduled maintenance, and can indicate successful operation to prevent unnecessary workovers for the purpose of checking the downhole equipment.

In another embodiment of the invention, recess 14 can be filled with an insulating fluid or an inert gas such as argon to prevent chemical deterioration of PCBA 20 and other electrical and electronic components. The pressure of the insulating fluid or inert gas can be monitored with pressure sensor to detect leaks in the integrity of recess 14, or to detect deterioration of PCBA 20 and other components within recess 14.

In alternative embodiments of the invention, a gas detector can be substituted for pressure sensor 40. Such gas detector can detect the presence of a gas formed within recess 14 or can detect the leakage of a gas into or away from recess 14. Insulating material such as a nonconductive fluid or an inert gas can be positioned within recess 14. The invention is uniquely suited to test the seal of recess 14 which protects downhole electronic components in a well. Recess 14 can be tested with a pressure, vacuum, or gas detection technique before the tool is run into a well. Additionally, recess 14 can be tested downhole in the well before packers or other downhole equipment are set to position the tool in the well. Testing can include limit tests and can include pressure and temperature cycling of the tool and components within recess 14. By providing a test apparatus and method to test the viability of the recess seal protecting downhole components, failures occuring during installation can be detected before well equipment is committed in the well.

Although the invention has been described in terms of certain preferred embodiments, it will be apparent to those of ordinary skill in the art that various modifications and improvements can be made to the inventive concepts herein without departing from the scope of the invention. The embodiments described herein are merely illustrative of the inventive concepts and should not be interpreted as limiting the scope of the invention.

What is claimed is:

1. A system for containing electronic components in a downhole well tool, comprising:

a cavity within the tool for containing the electronic components;

a wire attached to the electronic components which extends outside of said cavity;

a seal between said wire and the tool for isolating said cavity from the well;

a vacuum pump engaged with said cavity for creating a vacuum within said cavity; and a gas sensor engaged with said wire and in contact with said cavity for detecting the presence of a gas within said cavity.

2. A system for containing electronic components in a downhole well tool, comprising:

a cavity within the tool for containing the electronic components;

a wire attached to the electronic components which extends outside of said cavity;

a seal between said wire and the tool for isolating said cavity from the well;

a vacuum pump engaged with said cavity for creating, a vacuum within said cavity; and a pressure sensor in contact with said cavity for detecting the pressure within said cavity, wherein said pressure sensor is engaged with said wire to transmit electrical signals indicating the pressure within said cavity.

3. A system for containing electronic components in a downhole well tool, comprising:

a cavity within the tool for containing the electronic components;

a wire attached to the electronic components which extends outside of said cavity;

a seal between said wire and the tool for isolating said cavity from the well;

a vacuum pump engaged with said cavity for creating a vacuum within said cavity;

a valve between said vacuum pump and the tool for permitting the removal of said vacuum pump from engagement with said cavity; and an inert gas within said cavity for contacting the electronic components.

4. A system for containing electronic components in a downhole well tool, comprising:

a cavity within the tool for containing the electronic components;

a wire attached to the electronic components which extends outside of said, cavity;

a seal between said wire and the tool for isolating said cavity from the well;

a vacuum pump engaged with said cavity for creating a vacuum within said cavity;

a valve between said vacuum pump and the tool for permitting the removal of said vacuum pump from engagement with said cavity; and an insulating fluid within said cavity for contacting the electronic components.

5. A system for monitoring a downhole well tool having electronic components with the tool; comprising:

a cavity within the tool for containing the electronic components, wherein said cavity is isolated from the well;

a pressure sensor in contact with cavity for detecting the pressure within said cavity and for generating signals indicating the cavity pressure;

a wire engaged with said pressure sensor for transmitting the signals generated by said pressure sensor; and a controller positioned at the well surface and engaged with said wire for receiving the signals generated by said pressure sensor and for displaying information indicating the pressure changes identified by such signals.

6. A system as recited in claim 5, wherein said electronic components are connected between said pressure sensor and said wire.

7. A system as recited in claim 5, further comprising an inert gas within said cavity for contacting the electronic components.

8. A system as recited in claim 5, further comprising an insulating fluid within said cavity for contacting the electronic components.

9. A system for monitoring a downhole well tool having electronic components with the tool, comprising:

a cavity within the tool for containing the electronic components, wherein said cavity is isolated from the well;

a pressure sensor in contact with said cavity for detecting the pressure within said cavity and for generating signals indicating the cavity pressure;

a wire engaged with said pressure sensor for transmitting the signals generated by said pressure sensor;

a controller positioned at the well surface and engaged with said wire for receiving the signals generated by said pressure sensor and for displaying information indicating the pressure changes identified by such signals; and a vacuum pump engaged with said cavity for creating a vacuum within said cavity.

10. A system as recited in claim 9, further comprising a valve between said vacuum pump and said cavity for permitting the removal of said vacuum pump from engagement with said cavity.

11. A method for containing electronic components in a well tool, comprising the steps of:

positioning the electronic components in a cavity within the tool;

closing the cavity to isolate the cavity from the downhole well environment;

positioning the well tool downhole in a well;

positioning a pressure sensor in contact with said cavity for detecting the pressure within said cavity and for generating signals indicating such pressure;

transmitting the signals generated by said pressure sensor to a controller at the well surface; and operating said controller to display information indicating the pressure within said cavity.

12. A method for containing electronic components in a well tool, comprising the steps of:

positioning the electronic components in a cavity within the tool;

closing the cavity to isolate the cavity from the downhole well environment;

positioning the well tool downhole in a well;

monitoring said cavity to identify environmental changes within said cavity; and positioning a gas detector in contact with said cavity to detect gas within said cavity.

* * * * *